US006315492B1

(12) United States Patent
McIntosh

(10) Patent No.: US 6,315,492 B1
(45) Date of Patent: Nov. 13, 2001

(54) ROAD REPAIR MATERIAL COMPRISING CEMENT AND A RESIN

(75) Inventor: James McIntosh, Nr Uckfield (GB)

(73) Assignee: RoadTechs Europe Limited, Suffolk (GB)

( * ) Notice: Subject to any disclaimer, the term of this patent is extended or adjusted under 35 U.S.C. 154(b) by 0 days.

(21) Appl. No.: 09/463,256

(22) PCT Filed: Jul. 24, 1998

(86) PCT No.: PCT/GB98/02215

§ 371 Date: Sep. 25, 2000

§ 102(e) Date: Sep. 25, 2000

(87) PCT Pub. No.: WO99/05076

PCT Pub. Date: Feb. 4, 1999

(30) Foreign Application Priority Data

Jul. 24, 1997 (GB) ..... 9715640
Oct. 28, 1997 (GB) ..... 9722755

(51) Int. Cl.[7] ..... E01C 11/18; E01C 23/02
(52) U.S. Cl. ..... 404/17; 404/107
(58) Field of Search ..... 404/15, 32, 31, 404/17, 107; 428/323

(56) References Cited

U.S. PATENT DOCUMENTS

| | | | | |
|---|---|---|---|---|
| 3,043,790 | | 7/1962 | Du Pont . | |
| 3,891,585 | * | 6/1975 | McDonald | 404/32 |
| 3,900,687 | * | 8/1975 | Meader, Jr. et al. | 428/425 |
| 3,909,474 | * | 9/1975 | Borchert et al. | 260/28 |
| 3,930,100 | * | 12/1975 | McDonald | 404/32 |
| 3,981,840 | * | 9/1976 | Yamamoto et al. | 260/42 |
| 4,057,528 | | 11/1977 | Hunt . | |
| 4,094,697 | * | 6/1978 | Rostler | 404/17 |
| 4,238,537 | * | 12/1980 | Kerr | 428/35 |
| 4,392,335 | | 7/1983 | Heiman . | |
| 4,430,463 | * | 2/1984 | Mullenax | 404/32 |
| 4,537,921 | * | 8/1985 | Uffner et al. | 404/32 |
| 4,540,726 | | 9/1985 | Sugama et al. . | |
| 4,545,699 | | 10/1985 | Uffner . | |
| 4,567,222 | * | 1/1986 | Hagenbach et al. | 404/32 |
| 4,737,407 | * | 4/1988 | Wycech | 428/323 |
| 4,863,308 | * | 9/1989 | Stotzel | 404/31 |
| 5,019,610 | | 5/1991 | Sitz et al. . | |
| 5,026,609 | * | 6/1991 | Jacob et al. | 404/32 |
| 5,122,009 | * | 6/1992 | Vivier | 404/31 |
| 5,385,401 | * | 1/1995 | Nath | 404/32 |
| 5,560,734 | * | 10/1996 | McIntosh et al. | 404/15 |

FOREIGN PATENT DOCUMENTS

| | | |
|---|---|---|
| 219790 | 8/1983 | (DE) . |
| 3836303 A1 | 3/1990 | (DE) . |
| 3836303 | 5/1990 | (DE) . |
| 29614457 | 11/1996 | (DE) . |
| 0 514363 A1 | 11/1992 | (EP) . |
| 1 126 296 A | 9/1968 | (GB) . |
| 1351005 | 4/1974 | (GB) . |
| 1 581 974 | 12/1980 | (GB) . |
| 2262521 A | 6/1993 | (GB) . |
| 53059234 | 11/1976 | (JP) . |
| 54131660A | 4/1978 | (JP) . |
| 62146302 | 12/1985 | (JP) . |
| 62146302 A | 12/1985 | (JP) . |
| 61106870 A | 5/1986 | (JP) . |
| 06048803 A | 7/1992 | (JP) . |
| 09059561 | 8/1995 | (JP) . |
| 9506735 B | 11/1992 | (KR) . |
| 430133 | 8/1993 | (SU) . |
| WO 89/06259 | 7/1989 | (WO) . |

OTHER PUBLICATIONS

Database WPI Week 9719, Derwent Publications Ltd., London, GB; Class A18, AN 97–209567, XP002082604 & JP 09 059561 A (Showa Shell Sekiyu KK), Mar. 4, 1997.

* cited by examiner

*Primary Examiner*—Thomas B. Will
*Assistant Examiner*—Raymond W Addie
(74) *Attorney, Agent, or Firm*—Nixon & Vanderhye

(57) ABSTRACT

A method of repairing potholes and cracks in a road surface is disclosed. The method provides a dry mix, non-bitumen based, polymer concrete, utilizing ethylene vinyl acetate pellets and/or rubber powder with at least on of a cement powder, aggregate, a second polymer material and a colorant. The method provides a repair material that can return the repaired roadway to use in a maximum of 2 hours.

10 Claims, No Drawings

ROAD REPAIR MATERIAL COMPRISING CEMENT AND A RESIN

The present invention relates to road surfacing materials and in particular their use in repairing holes in damaged roads.

Throughout this specification, the word road is intended to include paths, runways, driveways and any other similar hard topped surface.

Many road surfaces are covered with bitumen or concrete to provide a hard surface. Over time these surfaces may be damaged, leading to spalling of the surface, 'pot-holes' and cracking. Traditionally, road surfaces have been repaired by cleaning the damaged area and applying bitumen or concrete to the damaged part to provide a flat load bearing surface again. However there are drawbacks to both these repair methods.

Bitumen based material is prepared off-site where the bitumen is heated to a high temperature and then mixed with aggregate etc. The mixed material is then poured into silicon lined bags and allowed to cool into solid blocks. These bags are then sold to contractors, etc who transport them to the site of the repair. On site, the bags are then stripped off and the blocks are heated in a boiler until they soften. Due to the size of the blocks and the high volume to surface area ratio, the melting process is slow. Once melted, the mixture is then poured into the damaged part of the road to provide a repaired surface. The bags must then be disposed of.

There are drawbacks with this method of repair. The repaired section is not as strongly adhered to the base material as an undamaged portion of road is. Therefore, it is prone to deteriorate again. Also, particularly where the original surface is concrete, the repair is quite apparent because the black bitumen material stands out against the much paler colour of the concrete. This can be undesirable from an aesthetic point as well as in terms of visibility, for example on concrete roads or domestic driveways. It is very difficult to overcome this problem by colouring the bitumen due to the sheer blackness of the bitumen. Large amounts of colorant are needed and even so the results are often poor. Furthermore, the cost of manufacturing the bitumen blocks and subsequently having to heat them on site to a high temperature (around 200° C.) makes it expensive. Once on site it can take 2 to 3 hours to melt a block which results in wasted time. Alternatively, the contractor may start heating the bitumen prior to arrival on site, i.e. carrying hot melted bitumen whilst in transit, which is clearly quite dangerous.

Another alternative repair material is concrete. This is usually transported to site in a pre-mixed form which requires it to be used fairly quickly. This makes it inconvenient to use. Concrete repairs suffer from similar problems to bitumen in that the repaired section generally deteriorates faster than the unrepaired sections and thus requiring further repair. Generally when concrete develops pot holes or severe cracking the whole concrete bay is removed to the foundation and replaced with new concrete. The process is expensive and time consuming causing the road to be closed for several days.

One more recent alternative is to use a cold applied epoxy resin based repair material The raw materials can be easily transported to site and mixed there prior to use. However this is relatively expensive. Furthermore, this method is very sensitive to the climatic conditions. For example, in cold or wet conditions, the curing time is considerably extended.

With all the above materials the time needed before the repaired road is useable again is quite high This is to allow the bitumen to cool, the concrete to set or the epoxy resin to cure. This can be of great importance for example when repairing busy motorways or runways where a long period during which the road or runway is unusable and cannot be reopened to traffic is unacceptable.

U.S. Pat. No. 3,043,790 discloses a non-bituminous resin binder used in conjunction with cement powder in the presence of water such that the binder enhances the properties of a conventional aqueous cement mixture.

GB-A-1126296 discloses a resin binder including a petroleum hydro carbon resin, again used in conjunction with both water and cement, and again disclosing the conventional aqueous cement curing operation. The composition is disclosed as being useful in place of solutions, emulsions, mastics or hot melt adhesives, for attaching the petroleum resin, and optionally cement.

According to a first aspect of the present invention there is provided a method of providing a road repair material comprising the steps of:

producing pellets of thermoplastic resin material;

dry mixing the resin pellets with cement powder and at least one of sand, aggregate, polymer material and colorant; and heating the mixed material until the resin softens.

A second aspect of the present invention provides a method of repairing a road surface comprising applying to a damaged portion of the road, the road repair material provided by the method of the first aspect The resin preferably has a melting temperature of around 90–100° C. An example of such a resin is Escorez (TM) available from Exxon Chemicals of Fareham. The resin is preferably non-opaque, e.g. transparent or translucent.

The cement powder combines with the resin to provide improved strength over pure resin. The inclusion of cement also improves the absorbent properties of the material.

Hydrocarbon resin has a higher setting hardening temperature (around 50° C.) than bitumen, which means that once in place in the road, it will reach its setting temperature earlier than bitumen, allowing the repaired road to be used in a maximum of 2 hours.

The resin is preferably manufactured and processed into marble sized pellets or flakes (prills). Unlike bitumen these pellets or flakes are 'dry' i.e. they are not sticky and as such are easily mixed with other material without the need for heat. By providing the resin material as small pellets, it can be heated to its melting temperature much more quickly and so much less heat is required to raise it to the required temperature. In contrast, because bitumen is difficult to form into small pieces and is thus provided in blocks, a longer heating time is required and so more heat is required.

These pellets or flakes are then mixed with the other ingredients of the repair material, the resin acting as a binder for these additional materials. These other ingredients might include stone aggregate, wood chip and/or sand for filling, colorant, other polymer materials (e.g. ethylene vinyl acetate, E.V.A., available as POLYBILT 102 (TM) from Exxon Chemicals of Fareham or rubber powder e.g. Styrene-Isoprene-Styrene rubber available as SOLT 190 from Enichem Elastomers Of London), or oil (e.g. Edelex (TM) available from Shell Chemical Company of Manchester) for improving flexibility of the resin binder. Fibres may also be included to provide additional reinforcement. This loose mixture is put into sacks which are then sold by the manufacturer for use on site. The road repairer empties the sacks into a heating boiler when on site to cause the resin to soften allowing the ingredients to mixed together before being poured into the pot-hole or crack in the road.

As little or no heating is required during the preparation stage, as is the case with bitumen based repair material, the cost of manufacture is reduced. The reduced temperature to which the resin must be heated means less energy is needed on site which means less fuel is burned and less needs to be transported to site.

The resin mixture is preferably provided in consumable sacks or bags which will melt when heated to the temperature required to soften the resin. These bags are preferably made of low melt plastic so that they melt when placed in the heating boiler.

By using consumable bags, there is less waste on site and the mixture is easier to put into the heating boiler. All these factors lead to a considerable saving in cost as well as a reduction in waste.

Other elements may be added to the resin mixture to vary the characteristics of the resultant repair to ensure compatibility with the surrounding material. For example the flexibility of the ultimate repair material can be modified by including a higher percentage of polymer, for example to give greater flexibility to joint or crack repairs. This is important with joints between slabs of concrete (e.g. in expansion gaps) where the sides of the joint may move. In contrast, when filling potholes or spalled areas on the load carrying surface, a harder mixture is preferable. In this case, a higher percentage of fillers is used in the mixture.

Traditionally, in particular with bitumen based repairs, rather than colouring the entire amount of the repair material, light coloured aggregate may be applied over the top of the repaired section to reduce the amount of colouring needed. However this surface layer will wear away with time causing the colour to fade. With the present invention, the colour added to the mixture is provided throughout the thickness of the material and so the colour will not fade as the surface wears.

The hydrocarbon resin of the present invention can be used to provide a road repair material which can be transported easily to site, is easily manufactured, can be prepared quickly and cheaply on site and applied to the damaged surface to provide a durable and long lasting repair. Furthermore, as the hydrocarbon resin is substantially clear or at least light in colour, relatively little colorant is required to achieve a wide range of colours. This is particularly useful for repairs to concrete where the colour can be matched to make an almost invisible repair.

A specific embodiment of a road repair material of the present invention will now be described by way of example only.

The repair material is initially prepared in bulk by manufacturing the raw resin material. This material is processed into small marble sized pieces as pellets or flakes which can be easily mixed with other materials and then bagged. Typically a mixture will contain around 12% by weight of resin (binder), 2½% cement powder, around 30% by weight of sand, around 52% by weight of aggregate, plus oil and colorant. Different compositions may be used according to the proposed application of the repair material.

The mixture is then packaged in bags or sacks which can be easily transported to site and require no special care during transit and which do not have a limited useable life as is the case with, for example, ready mixed concrete.

Once on site the sacks are emptied into a heating boiler which causes the resin to melt. The resin, aggregate, sand and any other materials required are mixed together to form the repair material. Colorant may be included in the sack during manufacture or added on site. By adding the colour on site, the specific colour of the road surface being repaired can be easily matched. The mixture may be provided in consumable bags which are put into the heating boiler to form part of the mixture. This means that the entire bag can be dropped into the heater without being opened, making the whole process much cleaner and simpler.

Once the mixture has been heated to the required temperature and suitably mixed, it can be applied to the damaged road, for instance in a conventional manner.

This method of repair is equally applicable to repairing spalled surfaces, pot-holes, cracks or joints.

As indicated above, the aggregate may include wood chips which will impart additional resilience to the resultant repair material.

EXAMPLE

An exemplary road repair material comprises:

525 kg of aggregate; 300 kg of sand; 25 kg of cement and 120 kg of binder comprising 90 kg of hydrocarbon resin and 30 kg of polymer additive.

What is claimed is:

1. A method of repairing potholes, spalling and cracks in a road surface comprising applying to a damaged portion of the road surface a road repair material prepared by:

(a) producing particles of a non-bitumen thermoplastic polymerized resin binder material, (b) dry mixing the binder resin particles with cement powder and at least one of sand, an aggregate, a second polymer material and a colorant, (c) heating the dry mixed material until the thermoplastic resin binder softens, and (d) applying the softened material to a damaged portion of the road surface.

2. The method of claim 1, wherein the thermoplastic polymerized binder resin particles include at least one of ethylene vinyl acetate and rubber powder as an additive.

3. The method according to claim 2, wherein the ratio of ethylene vinyl acetate and/or rubber powder to thermoplastic polymerized resin is 1:3.

4. The method according to claim 1, wherein the ratio of thermoplastic polymerized resin binder material to cement powder is from 3:1 to 6:1 by weight.

5. The method according to claim 1, wherein the ratio of thermoplastic polymerized resin binder material to cement powder is 4.5:1 to 5.1 by weight.

6. The method according to claim 1, wherein the road repair material comprises 4–6 kg of aggregate and 2–3 kg of sand per kg of thermoplastic polymerized resin binder material.

7. The method according to claim 1, wherein the aggregate includes reinforcing fibers.

8. The method according to claim 1, wherein the aggregate includes wood chips.

9. The method according to claim 1, in which the thermoplastic polymerized resin is a petroleum hydrocarbon resin selected from the group consisting of substantially transparent and substantially translucent resins.

10. A method of repairing potholes, spalling and cracks in a road surface comprising applying to a damaged portion of the road surface a road repair material prepared by the successive steps of:

(a) producing particles of a non-bitumen thermoplastic polymerized resin binder material, (b) dry mixing the binder resin particles with cement powder and at least one of sand, an aggregate, a second polymer material and a colorant, (c) placing the dry mixture in an meltable plastic bag, (d) inserting the meltable plastic bag filled with the dry mixture in a heating device and heating the dry mixture and bag until the thermoplastic resin binder and bag soften to form a softened material, and (e) applying the softened material to a damaged portion of the road surface.

* * * * *